US006237253B1

(12) United States Patent
Feuerecker

(10) Patent No.: US 6,237,253 B1
(45) **Date of Patent: *May 29, 2001**

(54) SHOE, OPTIONALLY SHOE WITH A HIGH UPPER

(75) Inventor: Heinz Feuerecker, Pfaffenhofen (DE)

(73) Assignee: "Lowa" Sportschue GmbH, Jetzendorf (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/080,692

(22) Filed: May 18, 1998

(30) Foreign Application Priority Data

May 23, 1997 (DE) ..... 197 21 702

(51) Int. Cl.[7] ..... A43B 23/26; A43B 3/00; A43B 5/04

(52) U.S. Cl. ..... 36/54; 36/113; 36/116; 36/117.1

(58) Field of Search ..... 36/54, 45, 113, 36/116, 117.1, 117.6, 93, 99

(56) References Cited

U.S. PATENT DOCUMENTS 2,261,824 11/1941 Brady .
3,413,736 * 12/1968 Spiteri ..... 36/54
4,406,073 * 9/1983 Spademan ..... 36/54
4,534,122 * 8/1985 MacPhail ..... 36/54
5,174,050 * 12/1992 Gabrielli ..... 36/54
5,289,645 * 3/1994 Marega et al. ..... 36/54
5,575,090 * 11/1996 Condini ..... 36/54

FOREIGN PATENT DOCUMENTS 87 14 500 U 2/1988 (DE) .
569829 * 11/1993 (EP) ..... 36/54

* cited by examiner

*Primary Examiner*—Paul T. Sewell
*Assistant Examiner*—Anthony Stashick
(74) *Attorney, Agent, or Firm*—Baker Botts L.L.P.

(57) ABSTRACT

A shoe with optionally a high upper such as a moutaineering boot or a sports shoe, comprises an upper and a tongue connected with said upper and having a foot-inside edge, a foot-outside edge and an edge close to a shin, said edge close to the shin connecting the foot-inside edge and the foot-outside edge. The tongue extends over a forefoot-instep portion of the shoe to at least an ankle-flexure portion of the shoe. For adapting to an instep-ankle-flexure contour of a foot it is approximatively formed in a saddle shape. In the ankle-flexure portion of the shoe the tongue comprises at least one, compared to adjacent tongue portions, flexurally softer, preferably flat flexing zone. The flexing zone reduces the tendency of the tongue to slip towards the side after wearing the shoe for some time, which prevents pressure sores or skin abrasions. This increases the wearing comfort of the shoe.

19 Claims, 2 Drawing Sheets

SHOE, OPTIONALLY SHOE WITH A HIGH UPPER

FIELD OF THE INVENTION

This invention relates to a shoe, optionally a shoe with a high upper such as a mountaineering boot, hiking boot, golf shoe or a sports shoe, comprising an upper and a tongue connected with s aid upper and having a foot-inside edge, a foot-outside edge and an edge close to a shin, said edge close to the shin connecting the foot-inside edge and the foot-outside edge, said tongue extending from a forefoot-instep portion of the shoe to at least an ankle-flexure portion of the shoe and being approximatively formed in a saddle shape for adapting to an instep-ankle-flexure contour of a foot.

BACKGROUND OF THE INVENTION

A problem associated with such shoe is that after wearing the shoe for some time the tongue slips, regularly towards the outer side of the foot. In particular, with shoes for sportive leisure time activities such as hiking boots, mountaineering boots or sports shoes, during which the foot is frequently moved to a large degree, a correspondingly large degree of friction against the shoe is generated, thus causing painful pressure sores or abrasions, when the tongue is not in its correct position relative to the foot. One reason for the slipping effect is that the tongues are usually preformed. In the process of performing they are precurved along the foot contour and, if necessary, along the contour of the lower leg. Depending on the material and the design of the tongue the preform can be attained in many different ways. Multi-layered tongues made of textile or/and leather materials, for instance, can obtain their preform by superimposing individual, non-preformed material layers of the tongue in the desired shape. By suitable stitching or glueing of the material layers a permanent preform can be attained. If plastics parts made of flexible plastics material are used for the tongue, the plastics parts can be manufactured in the desired form, e.g. by injection moulding. It is also conceivable to press the tongue into its desired shape. If, during walking, the forefoot or metatarsus is now bent towards the tibia (shin), the tongue is correspondingly bent in the ankle flexure portion. In order to retain its preformed shape the tongue thus slips away from the lower leg pressing towards the front. The consequence is that it slips to the side. The reason why in most cases it slips to the outer side of the foot can be found in the anatomical differences between the foot-outside and the foot-inside. Usually these anatomical differences are not taken into account in performing the tongue; a symmetrical shape is much rather given to the tongue with respect to a cross-section taken transverse across the instep.

The slipping of the tongue can be particularly painful in shoes or boots with ankle height or shin height with tongues that extend over the ankle flexure portion of the shoe, since in such cases the tongue can easily slip over the ankle, in particular over the lateral malleolus, where abrasions or pressure sores are particularly painful and considerably impair the wearing comfort.

SUMMARY OF THE INVENTION

It is an object of the invention to increase the wearing comfort of a shoe as mentioned at the beginning.

To achieve this object in accordance with the invention it is proposed that said tongue comprises, in the ankle-flexure portion of the shoe, at least one, optionally flat flexing zone, which is flexurally softer than adjacent tongue portions.

It turned out that in such shoes the propensity of the tongue to slip towards the side is considerably reduced, even when the shoe is used for activities requiring a high degree of motion such as hiking or running. This increases the comfort of the shoe and circumvents painful abrasions or pressure sores on the foot. The enhanced positional stability of the tongue can even be attained in the case of very slim feet, the danger of slipping of which is generally very great. By means of the flexing zone the tongue puts up a lower flexural resistance to the lower leg pressing to the front during a walking motion. Thus the tongue follows the lower leg to the front without slipping towards the side. During the overall movement the tongue clings to the foot, and optionally to the lower leg—if the tongue is that long. It is of considerable advantage that the clinging effect remains even during such movements, during which the lower leg moves towards the back relative to the foot, as is, for instance, the case when descending from a mountain. In conventional shoes the contact between the lower leg and the tongue loosens considerably, so that the tongue can easily slip towards one side, whereas in the solution in accordance with the invention the flexing zone enables the tongue to remain in a permanent contact with the lower leg thus stabilizing the foot-inside the shoe. Without great resistance the tongue can go through any deformations caused by the backward and forward movements of the lower leg relative to the foot.

In particular in shoes with ankle height it is expedient for stabilizing the foot in the portion of the upper edge of the shoe, when the flexing zone is spaced from the edge of the tongue close to the shin and said tongue is terminated by an edge zone at its edge close to the shin, said edge zone being flexurally stronger than the flexing zone.

In a preferred embodiment of the invention the flexing zone extends only over a part of the width of the tongue between the foot-inside edge of the tongue and the foot-outside edge of the tongue. This guarantees that a portion of the tongue lying above the flexing zone towards the tibia and a portion of the tongue lying beneath the flexing zone towards the metatarsus are connected by a flexurally stronger connecting strip, left open by the flexing zone, so that the overall shape of the tongue remains unchanged and the two mentioned portions of the tongue do not move relative to each other.

The propensity in known tongue designs to particularly slip towards the foot-outside can substantially be ascribed to the asymmetrical anatomy of the human foot. To counteract this tendency it is advisable to asymmetrically form the tongue. It is therefore proposed that said flexing zone is formed asymmetrically relative to a midline of the tongue in the middle between the foot-inside edge of the tongue and the foot-outside egde. In tongues in which the flexing zones extend only over part of the width of the tongue this asymmetry can particularly consist in the fact that the flexing zone is offset towards the foot-inside edge of the tongue relative to the midline of the tongue. For it has shown that the position-stabilizing effect of the flexing zone acting on the tongue occurs in particular when the flexural strength in the foot-inside portion of the tongue is diminished. The anatomy the tongue gives rise to the fact that during walking the deformation of the ankle-flexure portion on the foot-inside is greater than on the foot-outside. Therefore the flexing zone can narrow towards the foot-outside edge of the tongue.

Due to the reasons mentioned above the flexing zone preferably extends to the foot-inside edge of the tongue. Likewise the flexing zone will expediently terminate at a distance from the foot-outside edge of the tongue, however, it has proven favourable when the flexing zone extends at least over the instep apex. The tongue can be stabilized further by the fact that at its foot-outside edge the tongue comprises an edge reinforcing structure extending over at least a portion opposite to the flexing zone. Such edge reinforcing structure has proven expediently when the flexing zone extends close to the foot-outside edge of the tongue.

It is conceivable that the tongue comprises at least one further flexing zone spaced from the flexing zone. The tongue can optimally adapt to deformations occurring during walking when a plurality of flexing zones are present. Good results can be achieved when said further flexing zone is offset relative to said first mentioned flexing zone towards the foot-outside edge of the tongue. When said further flexing zone extends to the foot-outside edge of the tongue, it is recommended that said further flexing zone is arranged offset relative to the first mentioned flexing zone away from the edge of the tongue close to the shin. Thus an adaption to the position of the lateral malleolus, which is lower than the position of the inner malleolus of a human foot, can be achieved.

The flexing zone can be made integral with at least a part of the material of the tongue. It can be made by material reduction of at least a part of the material of the tongue, for instance, subsequent abrading of a leather tongue can give rise to material reduction. In the case of plastics tongues made by injection moulding such portions with material reduction may be formed in during the injection moulding process. Frequently the tongue has a multi-layered design, for instance with a vapour-permeable inner layer, a padded layer and a moisture-repellent outer layer. In this multi-layered design of the tongue at least one of the layers of the tongue, preferably the padded layer, can be recessed in the region of the flexing zone for the formation of the flexing zone.

As an alternative it is also conceivable that a separately made flexing insert is inserted in a recess of the tongue for the formation of the flexing zone and is there connected with the tongue. Such a separate flexing insert can best be formed with respect to a desired flexural softness and can be connected with the tongue, e.g. by stitching or glueing. The flexing insert can either have a single-layered or a multi-layered design. It is conceivable that the flexing insert is covered by a cover material layer at the inner side or/and the outer side of the tongue to improve the optical impression and to cover seams or glued joints.

The tongue can further be adapted to the asymmetrical anatomy of a human foot in that the tongue—when viewed along a cross-section from the foot-inside edge of the tongue to the foot-outside edge of the tongue—comprises portions of different tongue thickness at least in a metatarsus-instep portion. This also reduces or even eliminates the tendency of the tongue to slip towards the side. Considering that in a human foot the instep tapers off more evenly from the instep apex to the foot-outside than towards the foot-inside, it is particularly advisable that the mean thickness of the tongue, seen from an instep apex of a foot, is greater towards the foot-outside edge of the tongue than towards the foot-inside edge of the tongue. Expediently the varying thickness of the tongue can substantially be based on a varying thickness of a tongue padding.

In at least ankle-high shoes, in which the tongue with its edge close to the shin is raised above an ankle portion of the shoe, the danger of pressure sores or skin abrasions can further be reduced in that the tongue has a recess at its foot-inside edge or/and its foot-outside, the contour of said recess at least partly extending around the inner and/or lateral malleolus of a foot inserted into the shoe. Such recesses, on the one hand, cause an additional positional fixation of the tongue relative to the foot ankles, and, on the other hand, guarantee that in the case of a slight slipping of the tongue, the tongue does not slip over one of the ankles thus causing painful sores at the foot.

BRIEF DESCRIPTION OF THE DRAWINGS

The invention will now be described, by way of example, with reference to the accompanying drawings, in which.

DESCRIPTION OF PREFERRED EMBODIMENTS

Figure 1:
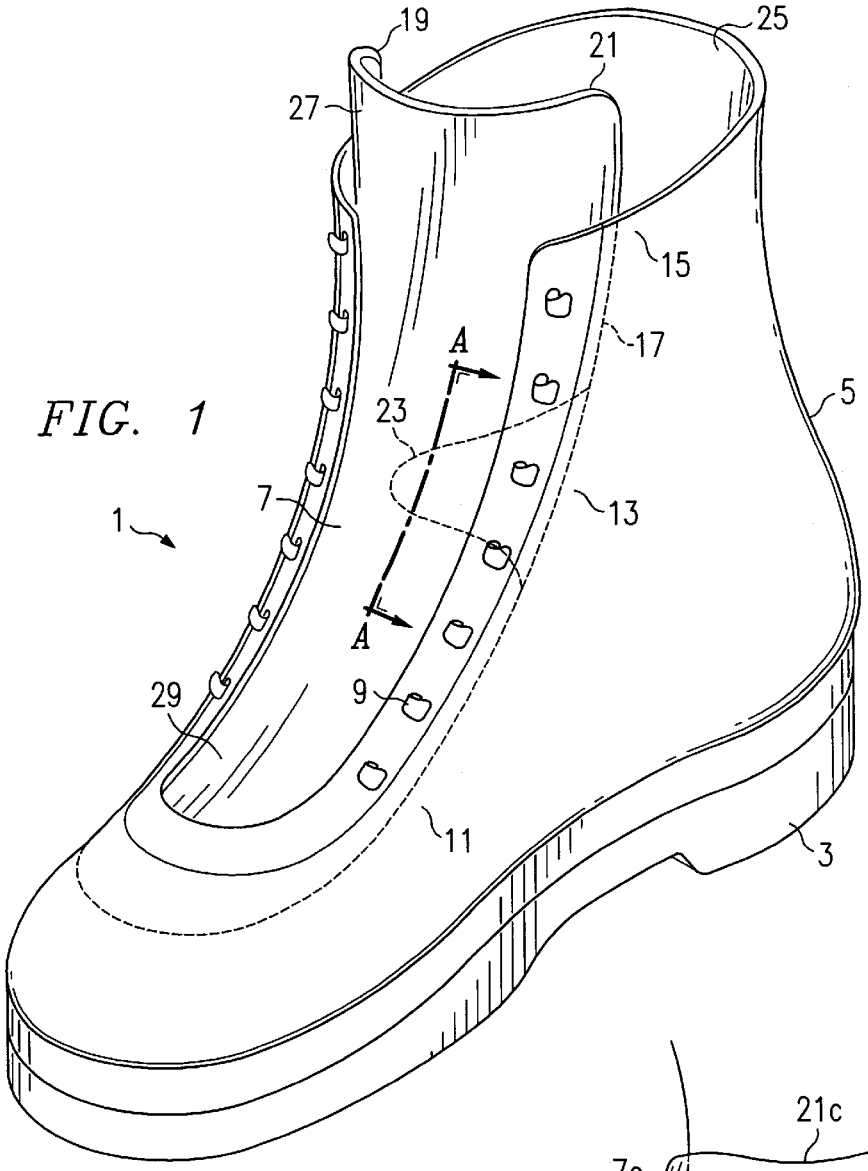
FIG. 1 illustrates a perspective view of a shoe in accordance with the invention.

In FIG. 1 a shoe is designated 1. This shoe comprises an upper 5 connected with a sole 3 and a tongue 7. The tongue 7 can be cut free as an integral portion from the material of the upper 5, but it can also be made as a separate part and sewed up with the upper or connected in any other way. The tongue 7 can also be formed as a pouch tongue, in which its lateral edges are connected to the upper 5 by means of a pouch. Eyelets 9 indicate a lacing.

Shoe 1 in FIG. 1 is illustrated as a shoe with ankle height. The tongue 7 extends from a forefoot-instep portion 11 of the shoe 1 over an ankle-flexure portion 13 of the shoe 1 to a portion 15 of the shoe close to a shin. The tongue comprises a foot-inside edge 17, a foot-outside edge 19 as well as an edge close to shin 21 interconnecting the foot-inside edge 17 and the foot-outside edge 19. FIG. 1 clearly illustrates that the tongue 7 is approximatively formed in a saddle shape in accordance with the instep and lower leg contour of a foot inserted into the shoe 1.

In the ankle-flexure portion 13, i.e. the site where the material of the shoe is deformed most during walking, a flexing zone 23 is contiguous to the foot-inside edge 17 of the tongue 7, the flexural strength of which is diminished relative to the remaining tongue portions. The flexing zone 23 preferably extends over at least the instep apex and progressively narrows from the foot-inside edge 17 of the tongue to the foot-outside edge 19 of the tongue. It terminates, however, before the foot-outside edge 19 of the tongue, such that between the foot-outside edge of the tongue 19 and the flexing zone 23 a strip of the flexurally stronger material of the tongue exists which stabilizes the tongue 7. This has the advantage that an edge portion 27 of the tongue close to the shin, extending from above the flexing zone 23 to an opening 25 of the shoe 1, does not loosely move relative to a portion 29 of the tongue close to the forefoot or metatarsus below the flexing zone 23.

Figure 2:
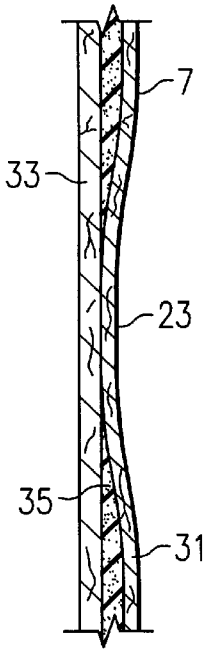
FIG. 2 illustrates a section along line A—A of FIG. 1 in a first embodiment.

FIG. 2 illustrates a section through the tongue 7, having a multi-layered structure with an outer layer 31, an inner layer 33 and a padded layer 35 lying between the outer and the inner layer 31, 33. The padded layer 35 can be formed of a soft textile material with padding properties. The tongue 7 can also be foamed in the region of the padded layer 35. The inside layer 33 can consist of a material which does not irritate the skin and is permeable to vapour. Materials used for the outer layer 31 can be any materials used as upper material in the shoe industry, such as leather, artificial leather, textile materials, plastics and optionally even metal. One of the layers of the tongue 7 can also be formed of a vapour-permeable, dampproof membrane, such as a membrane known with its tradename "Goretex".

In the region of the flexing zone 23 the padded layer 35 is recessed. Besides a reduced tongue thickness, this leads to a reduced flexural strength of the tongue 7 in the region of the flexing zone 23. It can be seen that the flexing zone 23 does not form a distinct transition to the adjacent portions of the tongue, but may rather form a gradual transition to the adjacent portions of the tongue by way of a progressive reduction in thickness of the padded layer 35. This is the reason why the flexing zone 23 is only indicated with a dashed line in FIG. 1.

In FIGS. 3 to 7 the same or equivalent components are designated with the same reference numerals as in FIGS. 1 and 2, however, supplemented by a small letter as an index.

Figure 3:
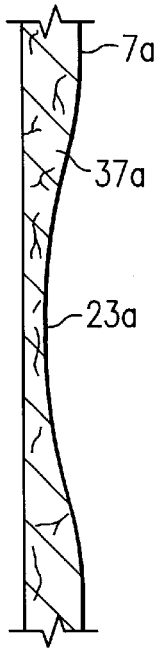
FIG. 3 illustrates a section along line A—A of FIG. 1 in a second embodiment.

FIG. 3 depicts a tongue $\mathbf{7}_a$ whose only one material layer $\mathbf{37}_a$ is reduced in a flexing zone $\mathbf{23}_a$. In the case of a leather tongue $\mathbf{7}_a$ this material reduction can be made by subsequent abrading of the leather material in the region of the flexing zone $\mathbf{23}_a$.

Plastics tongues can be injection moulded in the form as illustrated in FIG. 3. Attention has to be paid to the fact that a material reduction, as shown in FIG. 3, and a recess of a tongue layer, as depicted in FIG. 2, can be combined with each other without further ado.

Figure 4:
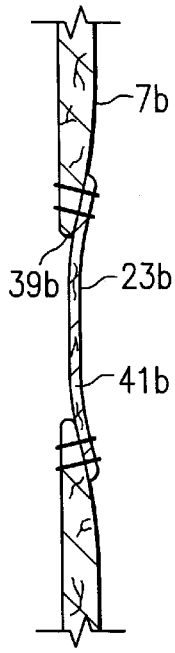
FIG. 4 illustrates a section along line A—A of FIG. 1 in a third embodiment.

FIG. 4 illustrates a tongue $\mathbf{7}_b$ which has a recess $\mathbf{39}_b$ in the region of a flexing zone $\mathbf{23}_b$ the size of which corresponds to the size of said flexing zone $\mathbf{23}_b$. This recess $\mathbf{39}_b$ is connected to a flexing insert $\mathbf{41}_b$ connected with the tongue $\mathbf{7}_b$. In the case of textile or leather materials of the tongue $\mathbf{7}_b$ and the flexing insert $\mathbf{41}_b$ they can be connected by means of stitching, as is illustrated in FIG. 4. Other possible connections are glueing or riveting. With respect to the material of the tongue $\mathbf{7}_b$ the flexing insert $\mathbf{41}_b$ is made of a flexurally softer material, so that this embodiment also has the desired enhanced flexibility of the tongue $\mathbf{7}_b$ in the ankle-flexure portion.

Figure 5:
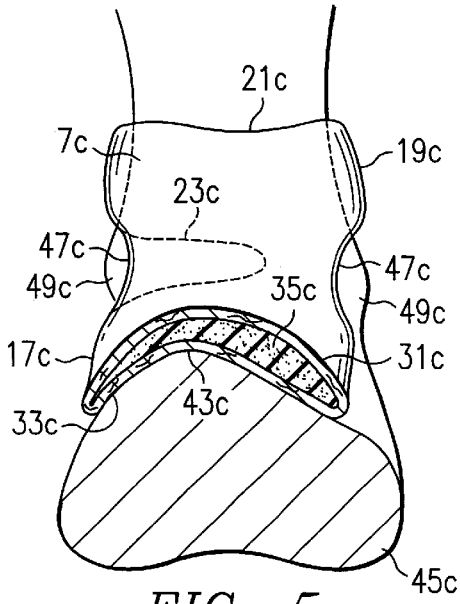
FIG. 5 illustrates a cut perspective view of a fourth embodiment of the invention.

FIG. 5 illustrates an embodiment of a multi-layered tongue $\mathbf{7}_c$ having between an inner layer $\mathbf{31}_c$ and an outer layer $\mathbf{33}_c$ a padded layer $\mathbf{35}_c$, the thickness of which is not constant between the foot-inside edge $\mathbf{17}_c$ of the tongue and the foot-outside edge $\mathbf{19}_c$ of the tongue in at least a portion of the tongue close to the forefoot or close to the instep and, if desired, also in a portion of the tongue close to the ankle-flexure. It can be seen that the thickness of the padded layer $\mathbf{35}_c$ first of all gradually increases from the foot-inside edge $\mathbf{17}_c$ of the tongue until it achieves a maximum value beyond the instep apex $\mathbf{43}_c$ of a foot $\mathbf{45}_c$. The site of said maximum value lies relatively close to the foot-outside edge $\mathbf{19}_c$ of the tongue $\mathbf{7}_c$, so that there is a clearly thicker padding in the portion of the tongue tapering off from the instep apex $\mathbf{43}_c$ to the outer side of the foot $\mathbf{45}_c$ than in the portion tapering off from the instep apex $\mathbf{43}_c$ to the inner side of the foot $\mathbf{45}_c$. This compensates for the asymmetrical shape of the foot $\mathbf{45}_c$ between its inner side and its outer side; said asymmetry can clearly be made out in FIG. 5. The asymmetrical padding of the tongue $\mathbf{7}_c$ counteracts the propensity of the tongue $\mathbf{7}_c$ to slip towards the outer side of the foot $\mathbf{45}_c$.

Furthermore FIG. 5 illustrates that the upper edge $\mathbf{21}_c$ of the tongue $\mathbf{7}_c$ is raised above the ankles $\mathbf{49}_c$ of the foot $\mathbf{45}_c$ and that the tongue has recesses $\mathbf{47}_c$ at the foot-inside edge $\mathbf{17}_c$ of the tongue and at the foot-outside edge $\mathbf{19}_c$ of the tongue. These recesses $\mathbf{47}_c$ expose the ankles $\mathbf{49}_c$ which, in turn, prevents sores which can be caused by friction of the tongue $\mathbf{7}_c$ at the ankles $\mathbf{49}_c$.

Figure 6:
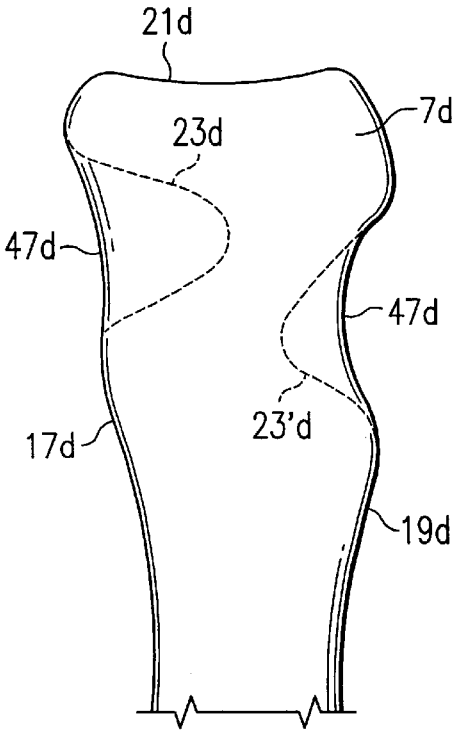
FIG. 6 illustrates a tongue of a shoe in a fifth embodiment of the invention.

FIG. 6 illustrates an embodiment of a tongue $\mathbf{7}_d$, having two flexing zones $\mathbf{23}_d$ and $\mathbf{23'}_d$ in its ankle-flexure portion. As is the case in the embodiments of FIGS. 1 to 5, the flexing zone $\mathbf{23}_d$ extends to the foot-inside edge $\mathbf{17}_d$ of the tongue $\mathbf{7}_d$ and terminates at a distance from the foot-outside edge $\mathbf{19}_d$ of the tongue. The flexing zone $\mathbf{23'}_d$, however, is contiguous to the foot-outside edge $\mathbf{19}_d$ of the tongue. It also extends only over a part of the width of the tongue $\mathbf{7}_d$ and terminates at a distance from the foot-inside edge $\mathbf{17}_d$ of the tongue. Analogous to the flexing zone $\mathbf{23}_d$ the flexing zone $\mathbf{23'}_d$ narrows towards the foot-inside edge $\mathbf{17}_d$ of the tongue. In the transverse direction of the tongue $\mathbf{7}_d$, i.e. from the foot-inside edge $\mathbf{17}_d$ of the tongue to the foot-outside edge $\mathbf{19}_d$ of the tongue, the two flexing zones $\mathbf{23}_d$, $\mathbf{23'}_d$ do not overlap in the embodiment of FIG. 6. It is also conceivable that they overlap in the transverse direction of the tongue. It can clearly be seen that the flexing zone $\mathbf{23'}_d$ is further away from the edge $\mathbf{21}_d$ of the tongue close to the shin than the flexing zone $\mathbf{23}_d$. This has to do with the anatomy of the human foot due to which the inner malleolus and the lateral malleolus do not lie on the same height. It can further be seen that the flexing zones $\mathbf{23}_d$, $\mathbf{23'}_d$ are located adjacent to recesses $\mathbf{47}_d$ which provide the tongue $\mathbf{7}_d$ with a contour adapted to the ankles at its foot-inside edge $\mathbf{17}_d$ and its foot-outside edge $\mathbf{19}_d$ as is the case in the embodiment of FIG. 5.

Figure 7:
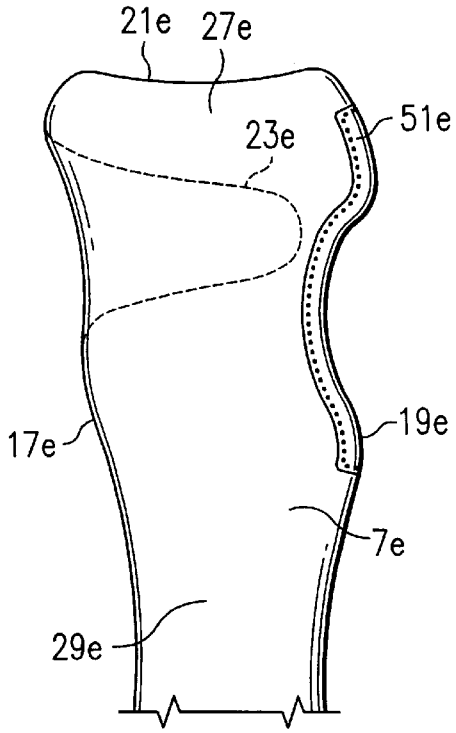
FIG. 7 illustrates a tongue of a shoe in a sixth embodiment of the invention.

FIG. 7 finally illustrates an embodiment of a tongue $\mathbf{7}_e$ having a flexing zone $\mathbf{23}_e$ extending from the foot-inside edge $\mathbf{17}_e$ of the tongue close to the foot-outside edge $\mathbf{19}_e$ of the tongue. To guarantee a connection having sufficient stiffness between the edge portion $\mathbf{27}_e$ of the tongue close to the upper edge $\mathbf{21}_c$ of the tongue and to the shin and the metatarsus portion $\mathbf{29}_e$ of the tongue, an edge reinforcement $\mathbf{51}_e$ is provided at the foot-outside edge $\mathbf{19}_e$ of the tongue, which can, for instance, be formed from a sewed on strip of the edge. It is also conceivable to incorporate a reinforcing slat made of plastics or metal into the tongue $\mathbf{7}_e$. The edge reinforcement $\mathbf{51}_e$ at least extends over a portion of the foot-outside edge $\mathbf{19}_e$ of the tongue opposite the flexing zone $\mathbf{23}_e$. Its flexural strength should be dimensioned so as not to considerably increase the flexural strength of the tongue $\mathbf{7}_e$ in the ankle-flexure portion, but rather to attain a stabilizing effect between the edge portion $\mathbf{27}_e$ of the tongue close to the shin and the metatarsus portion $\mathbf{29}_e$ of the tongue.

The design of the tongue in accordance with the invention can also be applied in shoes comprising an outer shoe and an inner shoe to be inserted into the outer shoe or a lining to be inserted into the outer shoe, either in the outer shoe as well as the inner shoe and the lining.

What is claimed is:

1. A walking shoe comprising an upper and a tongue connected with said upper and having a foot-inside edge, a foot-outside edge and an edge close to a shin, said edge close to the shin connecting said foot-inside edge and said foot-outside edge, said tongue extending from a forefoot-instep portion of said shoe to at least an ankle-flexure portion of said shoe and being formed substantially into a saddle shape for adapting to an instep-ankle-flexure contour of a wearer's foot, said tongue having in said ankle-flexure portion of said shoe a flexing portion including a flexing zone which is flexurally softer than adjacent tongue portions, said flexing zone extending over only part of the width of the tongue between the foot-inside edge and the foot-outside edge, extending over the instep apex, and being offset toward the foot-inside edge with respect to a centerline of said tongue midway between said foot-inside edge and said foot-outside edge such as to inhibit a tendency of said tongue to slip towards the outside of the wearer's foot when said tongue is bent while walking.

2. The shoe of claim 1, wherein said flexing zone is spaced from said edge close to the shin and wherein said tongue, at its edge close to the shin, is terminated by an edge zone which is flexurally stronger than said flexing zone.

3. The shoe of claim 1, wherein said flexing zone narrows towards said foot-outside edge of said tongue.

4. The shoe of claim 1, wherein said flexing zone extends to said foot-inside edge of said tongue.

5. The shoe of claim 1, wherein said flexing zone terminates at a distance from said foot-outside edge of said tongue.

6. The shoe of claim 5, wherein said tongue comprises, at its foot-outside edge, an edge reinforcing structure extending at least over a portion of said tongue which portion is opposite to said flexing zone.

7. The shoe of claim 5, wherein said tongue comprises at least one further flexing zone spaced from said flexing zone, said further flexing zone being offset towards said foot-outside edge of said tongue with respect to said first mentioned flexing zone.

8. The shoe of claim 7, wherein said further flexing zone extends to said foot-outside edge of said tongue and is offset away from said edge of said tongue close to the shin with respect to said first mentioned flexing zone.

9. The shoe of claim 1, wherein said flexing zone is made integral with at least a part of the material of said tongue.

10. The shoe of claim 9, wherein said flexing zone is made by material reduction of at least a part of the material of said tongue.

11. The shoe of claim 9, wherein said tongue is composed of a multi-layer structure and wherein at least one of the layers of said tongue, preferably a padded layer, is recessed in the region of said flexing zone.

12. The shoe of claim 1, wherein said flexing zone is formed of an insert member which is made separately from said tongue, said insert member being inserted in a recess of said tongue and connected therewith.

13. The shoe of claim 1, wherein said tongue—when viewed along a cross-section from said foot-inside edge to said foot-outside edge—comprises portions of different tongue thickness at least in a forefoot-instep portion of said tongue.

14. The shoe of claim 13, wherein a mean thickness of said tongue, viewed from an instep apex of a foot, is greater towards said foot-outside edge than towards said foot-inside edge.

15. The shoe of claim 13, wherein the varying thickness of said tongue is substantially based on a varying thickness of a tongue padding.

16. The shoe of claim 1, wherein said tongue, with its edge close to the shin, extends above an ankle portion of said shoe and wherein at least one of said foot-inside and foot-outside edges of said tongue is recessed in the region of a respective inner or lateral malleolus of a foot inserted into said shoe such as to extend at least partly around the respective malleolus.

17. The shoe of claim 1, wherein said flexing zone extends to said foot-inside edge of said tongue and terminates at a distance from said foot-outside edge of said tongue that is closer to said foot-outside edge than to said foot-inside edge.

18. The shoe of claim 17, wherein said flexing zone terminates at a distance close to said foot-outside edge, and a strip of said tongue that is flexurally stronger than said flexing zone lies between said flexing zone and said foot-outside edge and connects the portion of said tongue above said flexing zone to the portion of said tongue below said flexing zone.

19. The shoe of claim 18, wherein said flexing zone narrows from said foot-inside edge towards said foot-outside edge.

* * * * *

UNITED STATES PATENT AND TRADEMARK OFFICE

CERTIFICATE OF CORRECTION

PATENT NO. : 6,237,253 B1
DATED : May 29, 2001
INVENTOR(S) : Feuerecker

It is certified that error appears in the above-identified patent and that said Letters Patent is hereby corrected as shown below:

Title page,
Item [57], ABSTRACT,
Line 1, "moutaineering" should read -- mountaineering --
Line 9, "approximatively" should read -- approximately --

Column 1,
Line 8, "s aid" should read -- said --
Line 13, "approximatively" should read -- approximately --
Line 34, "glueing" should read -- gluing --
Line 50, "transverse" should read -- transversely --

Column 2,
Line 50, "egde." should read -- edge. --

Column 3,
Line 6, "expediently" should read -- expedient --
Line 19, "adaption" should read -- adaptation --
Line 42, "glueing" should read -- gluing --

Column 4,
Line 45, "approximatively" should read -- approximately --

Column 5,
Line 12, ""Goretex"." should read -- "Gore-Tex". --
Line 43, "glueing" should read -- gluing --

Signed and Sealed this

Twenty-sixth Day of March, 2002

*Attest:*

*Attesting Officer*

JAMES E. ROGAN
*Director of the United States Patent and Trademark Office*